US005884450A

United States Patent [19]

Ronchi

[11] Patent Number: 5,884,450

[45] Date of Patent: Mar. 23, 1999

[54] DEVICE FOR RAPIDLY MOUNTING/ RELEASING UNITS FOR FITTING CAPS OR LIDS TO CONTAINERS, IN PARTICULAR FOR MANDRELS OF AUTOMATIC MACHINES

[75] Inventor: Mario Ronchi, Cologno Monzese, Italy

[73] Assignee: Ronchi Mario S.R.L., Cessate, Italy

[21] Appl. No.: 996,333

[22] Filed: Dec. 22, 1997

[30] Foreign Application Priority Data

Dec. 23, 1996 [IT] Italy ..... MI96A2729

[51] Int. Cl.[6] ..... B65B 7/28

[52] U.S. Cl. ..... 53/317; 53/331.5; 53/334; 53/281

[58] Field of Search ..... 53/317, 201, 331.5, 53/334, 281

[56] References Cited

U.S. PATENT DOCUMENTS

| | | | |
|---|---|---|---|
| 3,491,516 | 1/1970 | Bergeron | 53/331.5 X |
| 3,524,294 | 8/1970 | Koll | 53/201 X |
| 3,955,341 | 5/1976 | Wilhere | 53/331.5 |
| 4,249,362 | 2/1981 | Brownhill | 53/331.5 X |
| 4,309,859 | 1/1982 | Schindel | 53/331.5 |
| 4,527,377 | 7/1985 | Hayashi et al. . | |
| 5,417,031 | 5/1995 | Bankuty et al. . | |

FOREIGN PATENT DOCUMENTS

| | | |
|---|---|---|
| 0 572 107 A1 | 12/1993 | European Pat. Off. . |
| 2 268 165 | 1/1994 | United Kingdom . |

*Primary Examiner*—Daniel B. Moon
*Assistant Examiner*—James P. Calve
*Attorney, Agent, or Firm*—Herbert Dubno

[57] ABSTRACT

A capping assembly includes at least one tube fixed to a spindle of an automatic machine and provided with a piston and cylinder unit for axially displacing a bush operatively connected with the tube and formed with a shaped recess to releasably engage a respective formation on a cup support upon displacement of the piston in the cylinder.

6 Claims, 2 Drawing Sheets

DEVICE FOR RAPIDLY MOUNTING/ RELEASING UNITS FOR FITTING CAPS OR LIDS TO CONTAINERS, IN PARTICULAR FOR MANDRELS OF AUTOMATIC MACHINES

SPECIFICATION

1. Field of the Invention

The present invention relates to a device for rapidly mounting/releasing units for fitting caps or lids to containers, in particular for mandrels of automatic machines.

2. Background of the Invention

In the technical sector relating to the preparation of containers such as bottles and the like, it is known of the need to fit the container sealing cap or lid once the said container has been filled.

It is also known that this operation is performed by means of automatic machines with several stations where the mandrels carrying the cap or lid fitting unit are located.

As a result of the difference existing between the various types of containers with associated cap or lid, however, it is necessary to have mandrels in which the cap or lid fitting unit is specific for each type of cap or lid to be fitted. These units must therefore be replaced whenever there is a variation in the type of cap or lid being processed and with the machine at a standstill.

OBJECTS OF THE INVENTION

It is therefore the primary object of the present invention to provide a device overcoming the drawbacks of the known prior art machines.

Still another object is to provide the device allowing reduction of a processing cycle.

Yet another object is to provide the device adaptable to machines of the

SUMMARY OF THE INVENTION

These technical problems are solved according to the present invention by a device for rapidly mounting/releasing units for fitting caps or lids to containers, in particular for mandrels of automatic machines, which comprises at least one tube which is fixed to the mandrel and on which there are coaxially mounted at least one bell-piece integral with said tube and at least one bush partially sealingly inserted in the bell-piece, so as to form a chamber, and designed to translate coaxially with the bell-piece under the thrusting action of resilient means and a fluid under pressure which can be supplied, upon command, to the chamber, there also being provided means for fixing the unit to the bush, which means extend radially from said unit and are designed to co-operate with a shaped eyelet formed on the side surface of the bush.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
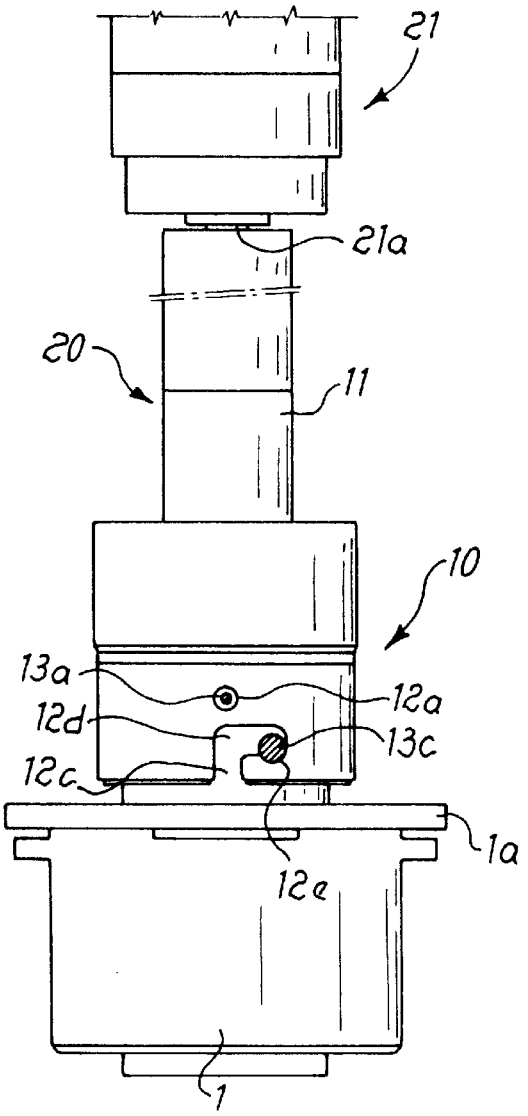
FIG. 1 is a front view of the rapid-engagement device according to the invention with the mandrel in the working position.

As illustrated, the device 10 for the rapid engagement of cap or lid fitting units 1 to mandrels 20 of filling machines, which are known per se and only schematically shown with the actuator 21 for moving the mandrel 20, comprises a tube 11 which is fixed to an axial extension 21*a* of the actuator 21 by means of screws 11*a* and which has, at its end opposite to the free end, a circular flange 11*b* provided with a radial toothing 11*c* designed to form the guide for sliding in the axial direction of a bush 12 which is provided with corresponding internal longitudinal grooves 12*b* and coaxially mounted over the tube 11. The external side surface of said bush 12 has, formed in it, a hole 12*a* and a shaped eyelet 12*c* respectively designed to allow insertion, through them, of a grub screw 13*a* for fixing the bush 12 to the flange 11*b* of the tube 11, and a screw 13*b* with a cylindrical head 13*c* which is screwed onto a support element 1*a* of the unit 1.

The shaped eyelet 12*c* has a horizontal section 12*d* with an axial recess 12*e* designed to contain partially the head 13*c* of the screw 13*b*.

In its cylindrical upper part the bush 12 has seats 15*a*, each of which houses a ball 15 and a spring 16 located above the ball.

The spring 16 is normally compressed, in a direction parallel to the axis of the mandrel, between said ball 15 and a disc 17 for upper closing of the bush 12, which is fixed to the latter by means of screws 17*a*.

The disc 17 is in turn inserted inside a cylindrical bell-piece 18 which is coaxial with the tube 12 and fixed to the latter by means of radial pins 18*a*; in this way the bell-piece 18 forms a cylinder, the piston of which consists in the assembly formed by the disc 17/bush 12 which can be moved in an axial direction and against the thrusting action of the springs 16, by means of compressed air supplied to the chamber 18*a* via a duct 18*b* formed on the bell-piece 18 and connected to the compressed-air source by means of a connecting nozzle 18*c*.

The travel of the disc/bush assembly is determined by two surfaces, i.e. an external surface 12*f* and internal surface 12*g* of the bush itself, which are perpendicular to the longitudinal axis and form an end-of-travel stop for the bush 12 against the flange 11*b* of the tube 11 and against the edge of the bell-piece 18, respectively.

Figure 2:
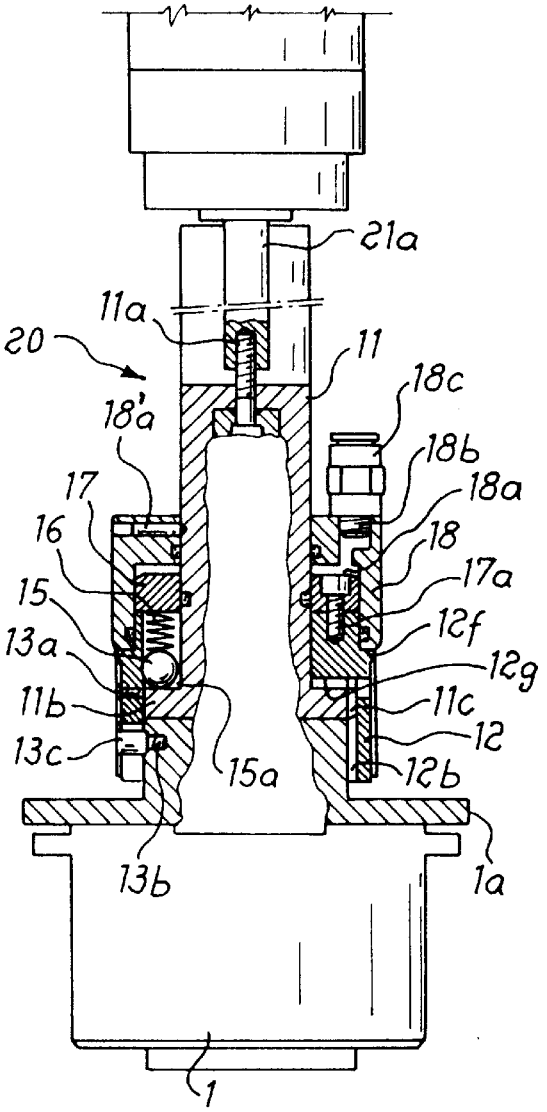
FIG. 2 is a diagrammatic cross-section along a longitudinal plane of the mandrel according to FIG. 1.

The device for rapid engagement/disengagement of the cap or lid fitting unit operates in the following manner:

Under normal working conditions (FIGS. 1, 2) the upper part 1*a* of the unit 1 is in abutment against the flange 11*b* of the fixed tube 11 and the body of the mandrel is rotated in an anti-clockwise direction so as to bring the head 13*c* of the screw 13*b* inside the recess 12*e* of the shaped eyelet 12*c*.

In these conditions the spring 16, reacting against the ball 15 in abutment on the fixed flange 11*b* of the tube 11, pushes the disc 17 upwards until the external abutment surface 12*f* of the bush 12 stops against the edge of the bell-piece 18.

The head 13*c* of the screw 13*b* is inserted into the axial recess 12*e* and the unit 1 is firmly retained in the delivery position.

Figure 3A:
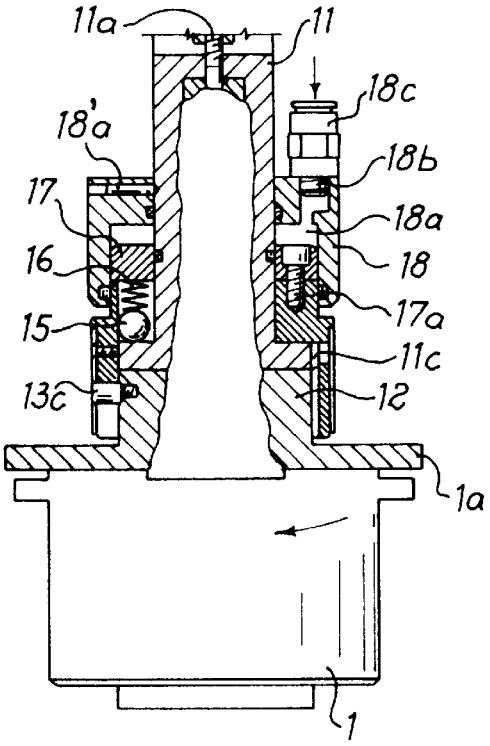
FIGS. 3*a* is axial sectional. view of the device in the released condition of the cap or lid fitting unit.
Figure 3B:
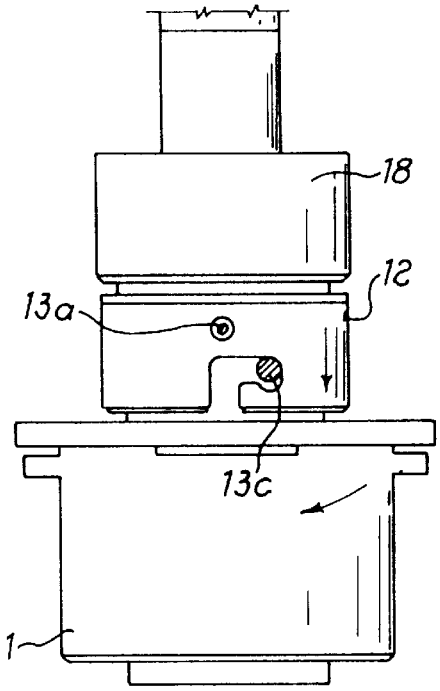
FIG. 3*b* is an elevational view of the device shown in FIG. 3*a;*
Figure 4A:
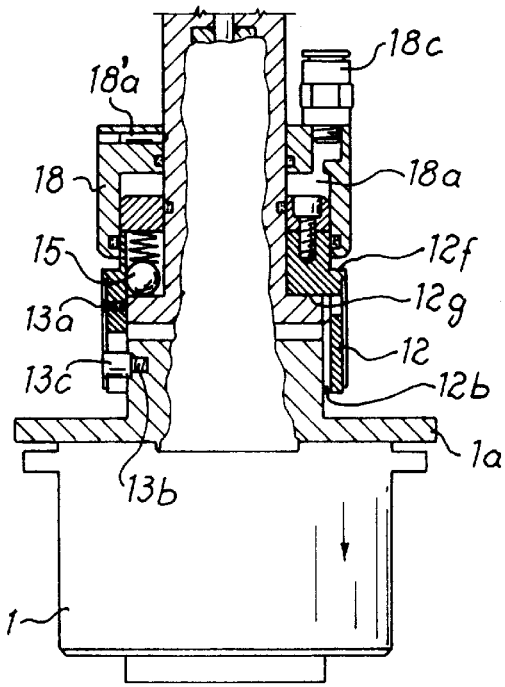
FIG. 4*a* is an axial section of the device in the extracted condition of the cap or lid fitting unit.
Figure 4B:
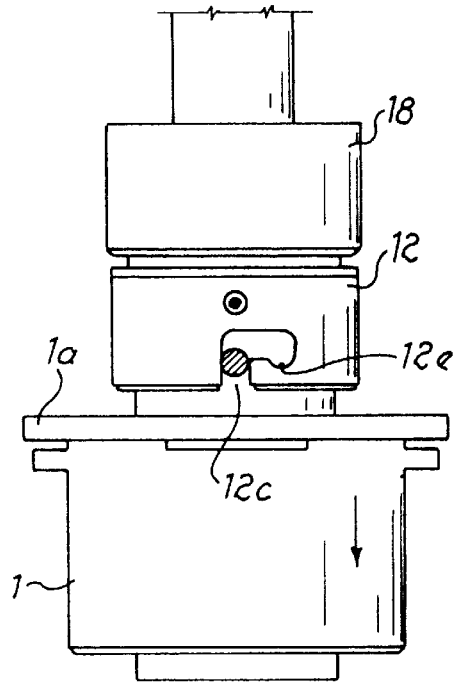
FIG. 4*b* is an elevational view of the device shown in FIG. 4*a.*

If the unit 1 is to be replaced, compressed air is supplied to the chamber 18*a* through the duct 18*c*, 18*b* (FIGS. 3*a*, 3*b*) so as to overcome the thrusting action of the spring 15 and push downwards the bush 12 and tube 11, which stops with its internal abutment surface 12*g* against the flange 11*b* of the tube. In this way the head 13*c* of the screw 13*b* is disengaged from the associated recess 12*e* of the eyelet 12*c* and the unit 1 is able to be rotated in an anti-clockwise direction (FIGS. 4*a*,4*b*) and translated downwards for extraction thereof.

In order to insert a new unit, the sequence is performed in reverse.

I claim:

1. A capping assembly comprising:

at least one mandrel rotatable about a respective axis in one direction;

a tube mounted on at least one mandrel and rotatable therewith about said axis and formed with an outer end;

a bell-piece mounted fixed on the tube and coaxial therewith and spaced axially from the outer end of the tube;

a bush mounted axially displaceable between inner and outer axial positions thereof on the outer end of the tube and rotatable about said axis in the inner position, the bush being formed with an eyelet means extending axially inwardly toward the bell-piece to form an annular chamber;

resilient means in said chamber braced against the bush for thrusting the latter into said inner position thereof;

pneumatic means in flow communication with said chamber for controllably counteracting said resilient means to axially displace said bush toward said outer position;

a cap holder received in said bush and formed with engaging means extending radially outwardly for releasably engaging the cap holder and said eyelet means in said inner position of the bush to rotate therewith.

2. The assembly defined in claim 1 wherein the outer end of the tube is formed with a radially outwardly extending flange formed with a peripheral surface which is provided with an outer radial toothing cooperating with inner axial slits to guide the bush axially between the inner and outer positions thereof.

3. The assembly defined in claim 1 wherein the bush is formed with an outer cylindrical portion spaced axially outwardly from the outer end of the tube and with an inner cylindrical portion having a diameter less than that one of the outer portion and penetrating axially inwardly said bell-piece to form a piston spaced axially from the outer end of the tube forming a seat in said chamber.

4. The assembly defined in claim 3 wherein said resilient means is braced between the seat and the piston and includes a spring.

5. The assembly defined in claim 1 wherein the bell-piece is provided with at least one through-duct communicating with the pneumatic means to build up a pressure in the chamber.

6. The assembly defined in claim 1 wherein said engaging means includes a pin and forms a bayonet connection to arrest said pin in an axial groove of said eyelet means.

* * * * *